US007661339B2

(12) United States Patent
Wu

(10) Patent No.: US 7,661,339 B2
(45) Date of Patent: Feb. 16, 2010

(54) DRIVING SURFACE CONFIGURATION FOR HAND TOOLS

(75) Inventor: Arthur Wu, Taichung (TW)

(73) Assignee: Proxene Tools Co., Ltd., Taichung (TW)

( * ) Notice: Subject to any disclaimer, the term of this patent is extended or adjusted under 35 U.S.C. 154(b) by 0 days.

(21) Appl. No.: 12/189,193

(22) Filed: Aug. 10, 2008

(65) Prior Publication Data

US 2008/0295652 A1 Dec. 4, 2008

Related U.S. Application Data

(63) Continuation of application No. 11/642,541, filed on Dec. 21, 2006, now abandoned.

(51) Int. Cl.
*B25B 13/06* (2006.01)
*B25B 13/08* (2006.01)

(52) U.S. Cl. ..... 81/186; 81/119; 81/121.1

(58) Field of Classification Search ..... 81/119, 81/121.1, 124.2, 124.3, 186
See application file for complete search history.

(56) References Cited

U.S. PATENT DOCUMENTS

| | | | | |
|---|---|---|---|---|
| 5,406,868 | A * | 4/1995 | Foster | 81/119 |
| 6,145,414 | A * | 11/2000 | Hsieh | 81/119 |
| 7,168,347 | B2 * | 1/2007 | Hsieh | 81/186 |
| 2006/0156869 | A1 * | 7/2006 | Hsieh | 81/121.1 |

* cited by examiner

*Primary Examiner*—D. S. Meislin
(74) *Attorney, Agent, or Firm*—Banger Shia

(57) ABSTRACT

A wrench includes a handle and an open-end with two jaws and each jaw has a driving surface. Each driving surface has a contacting area and two yielding areas. The contacting area is located between the two yielding areas and includes a contact portion and two notches. The contact portion is located between the two notches, and two extension areas each are connected between the yielding area and the notch corresponding thereto. A corner is formed at a joint area of the contact portion and an inside of the notch so as to bite a rounded fastener head. The contact portions are matched with straight sides of a normal fastener head.

7 Claims, 8 Drawing Sheets

DRIVING SURFACE CONFIGURATION FOR HAND TOOLS

This application is a Continuation Application of previously U.S. application Ser. No. 11/642,541, now abandoned, and claims the priority of the filing date of Dec. 21, 2006, and claims 1-7 in the current Continuation Application correspond to claims 1-11 in the parent application, respectively, and are entitled to the parent application's filing date of Dec. 21, 2006.

BACKGROUND OF THE INVENTION (1) Field of Invention (2) Description of the Prior Art A conventional hand tool for driving a fastener head is experienced a problem that the driving surfaces of the jaws for an open-end wrench, for example, cannot precisely matched with the straight sides of the fattener head so that when rotating the wrench, the corners of the fattener head is rounded off. Some wrench has special design to the configuration of the driving surfaces and can bite the rounded fastener head and successfully drive the rounded fastener head. However, these special designed wrench causes marring to the normal fastener head and sharpens the sides of the fastener head. After the fastener is loosened, the user rotates the fattener out form threaded rod and the user's fingers might be cut by the sharp sides of the fastener head. Some of these designs known to applicant are disclosed in U.S. Pat. No. 5,860,339, U.S. Pat. No. 6,009,778, U.S. Pat. No. 5,148,726, U.S. Pat. No. 5,117,714, U.S. Pat. No. 5,074,171, and U.S. Pat. No. 6,145,414.

U.S. Pat. No. 5,406,868 and U.S. Pat. No. 5,381,710 disclose a wrench with open-end and the two jaws each have a rounded ridge extending therefrom so as not to mar the sides of fastener heads. Nevertheless, when driving a rounded fastener head, an assistance tool such as a pair of locking pliers have to be used to hold the fastener.

The present invention intends to provide a driving surface configuration for a hand tool and each driving surface includes a contacting area and two yielding areas, the contacting area protrudes from the driving surface and includes a contact portion and two notches, wherein the contact portion matches with sides of normal fastener and the notches effectively bite the rounded fastener.

SUMMARY OF THE INVENTION

The present invention relates to a wrench which comprises a handle and an open-end connected to the handle. The open-end has two jaws and each jaw has a driving surface. Each driving surface has a contacting area and two yielding areas. The contacting area is located between the two yielding areas of each driving surface and the contacting area includes a contact portion and two notches. The contact portion is located between the two notches. Two extension areas each are connected between the yielding area and the notch corresponding thereto. A corner is formed at a joint area of the contact portion and an inside of the notch.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
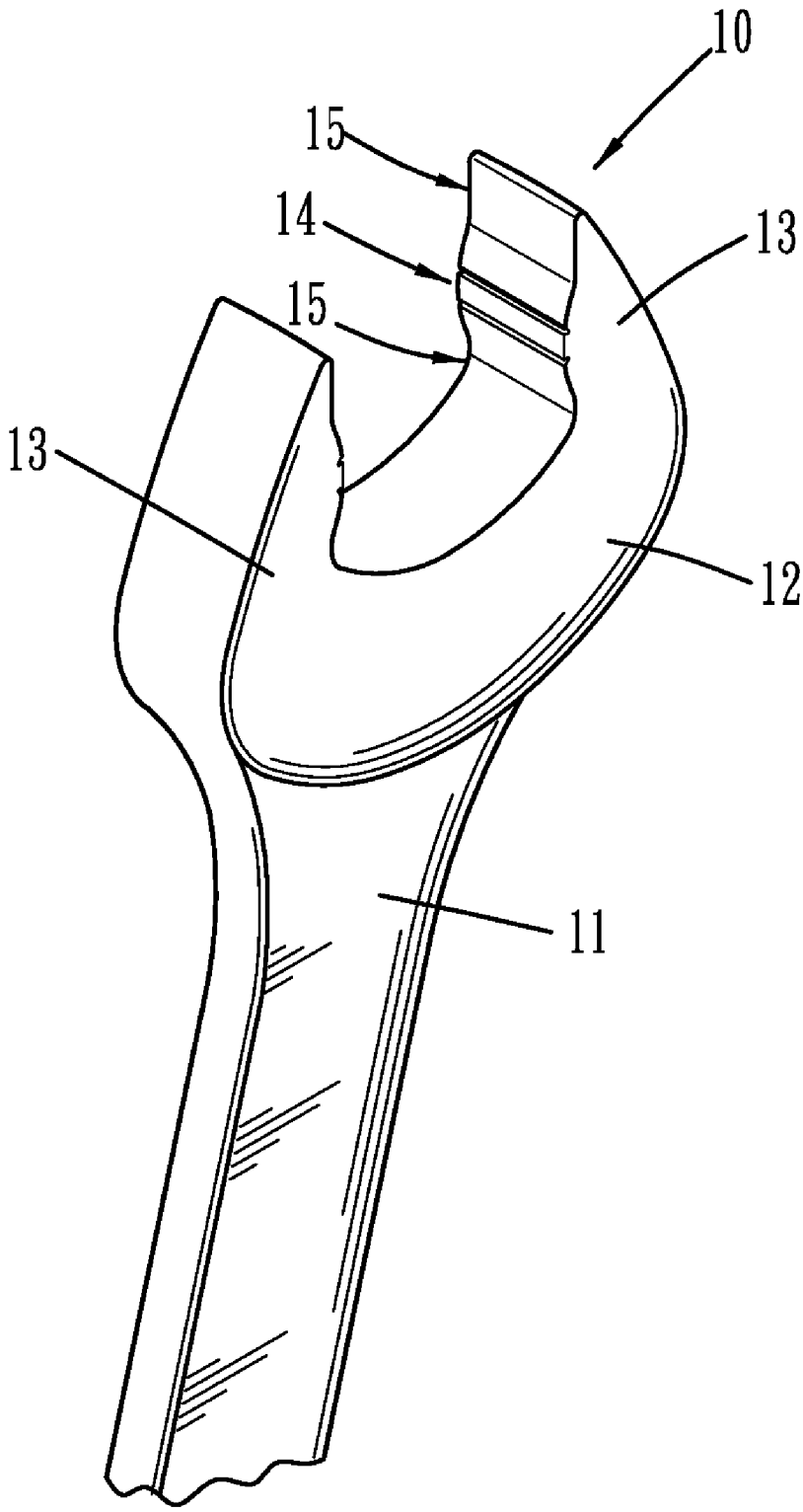
FIG. 1 is a perspective view to show the wrench with an open-end of the present invention.
Figure 2:
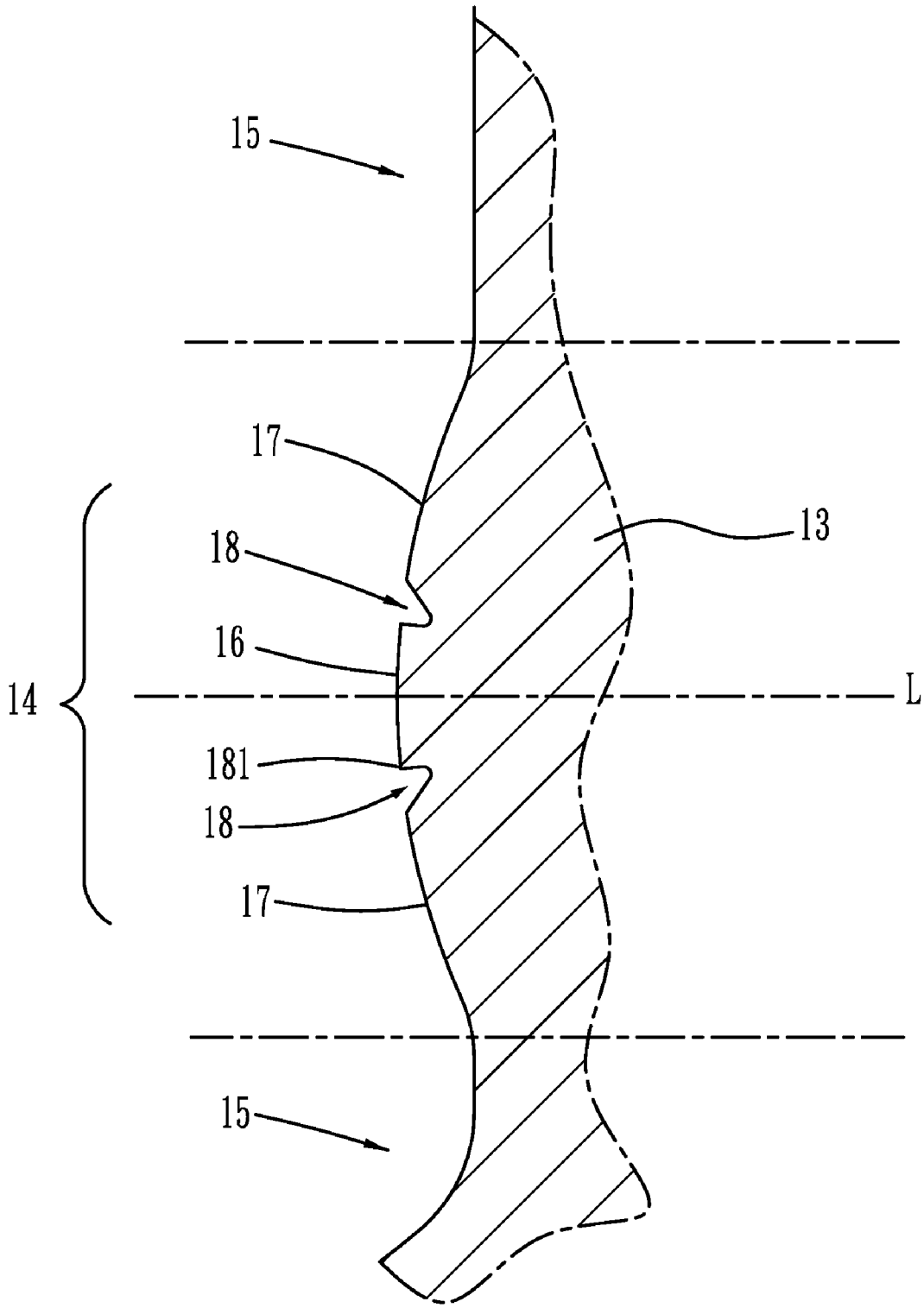
FIG. 2 is a cross sectional view to show each one of the two jaws.

Referring to FIGS. 1 and 2, the wrench 10 of the present invention comprises a handle 11 and an open-end 12 is connected to the handle 11. The open-end 12 includes two jaws 13 and each jaw 13 has a driving surface wherein the two driving surfaces of the two jaws 13 face each other. Each driving surface has a contacting area 14 and two yielding areas 15, wherein the contacting area 14 is located between the two yielding areas 15 of each driving surface and the contacting area 14 includes a contact portion 16 and two notches 18. The contact portion 16 is located between the two notches 18. Two extension areas 17 each are connected between the yielding area 15 and the notch 18 corresponding thereto. Each notch 18 has a plane surface and an inclined surface formed therein. A perpendicular corner 181 is formed at a joint area of the contact portion 16 and the plane surface of the notch 18, and an obtuse corner is formed at a joint area of the inclined surface and the extension area 17. Each contact portion 16 includes a curved outer surface and a bisection line "L" of each jaw 13 is perpendicular to a longitudinal axis of each jaw 13 and passes through a middle point of the contact portion 16. More specifically, the contact portion 16 and the two extension areas 17 as a whole define a protrusive arced surface, and the arced surface has discontinuous points at the two notches 18. The contact portion 16 is the most protrusive part of the arced surface. The two yielding areas 15 are a straight area and a curved and recessed area respectively, wherein the straight area is located remote to a root of the open-end 12.

Figure 4A:
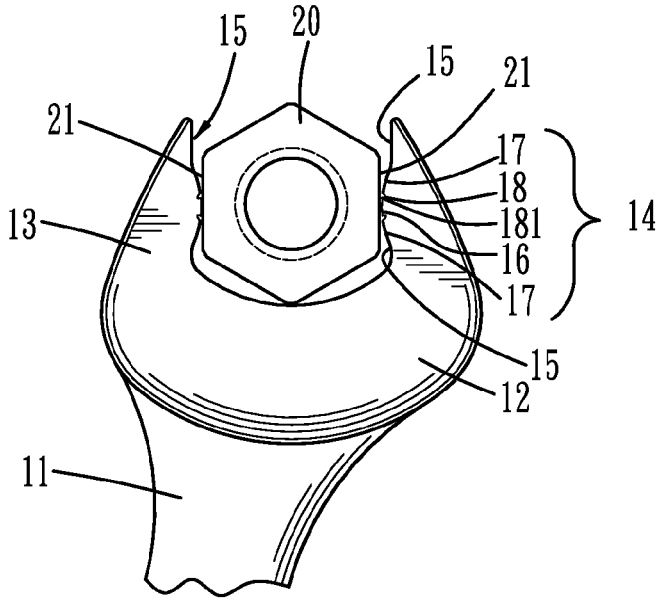
FIG. 4A shows a normal fastener is clamped between the two jaws of the wrench of the present invention.
Figure 4C:
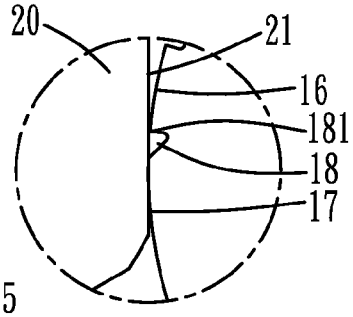
FIG. 4C is an enlarged view to show that the contact area is in contact with one side of the fastener head in FIG. 4B.
Figure 4B:
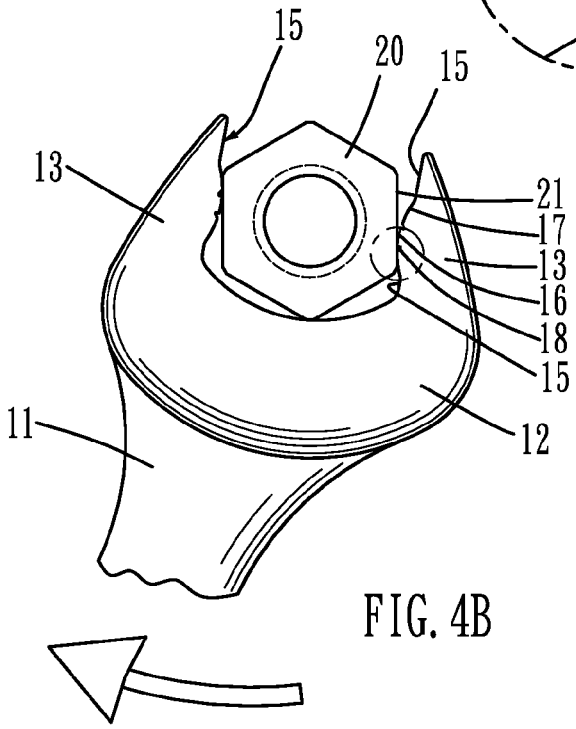
FIG. 4B shows that the wrench is rotated clockwise and the contact areas of the two jaws are in contact with two sides of the fastener head.

Referring to FIGS. 4A to 4C, when clamping a normal fastener head 20 with six straight sides 21 between the two driving surfaces of the two jaws 13, the contact areas 14 are in contact with the two sides 21 of the fastener head 20. When rotating the wrench clockwise, the extension areas 17 are still in contact with the sides 21 of the fastener head 20 and the corners of the fastener head 20 are located in the yielding areas 15 so that the corners of the fastener head 20 are not marred.

Figure 5B:
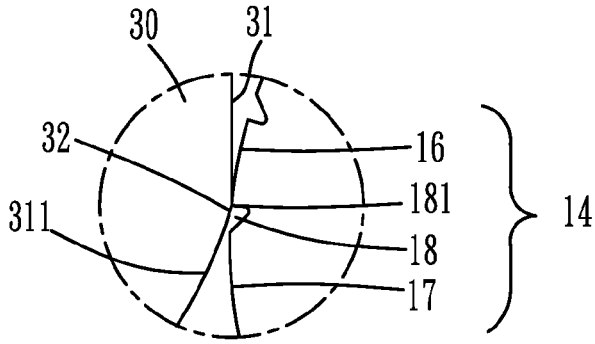
FIG. 5B is an enlarged view to show that the corner bites the rounded side of the fastener head.
Figure 5A:
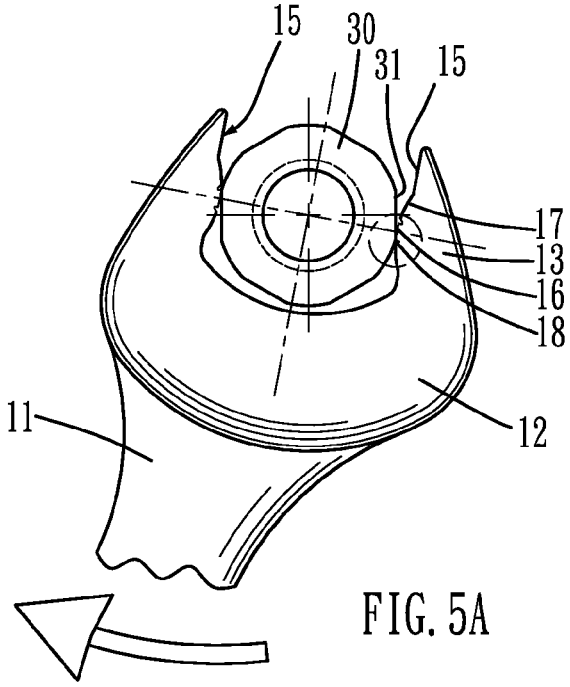
FIG. 5A shows a rounded fastener head is clamped by the two jaws of the wrench of the present invention and the wrench is rotated clockwise.
Figure 5D:
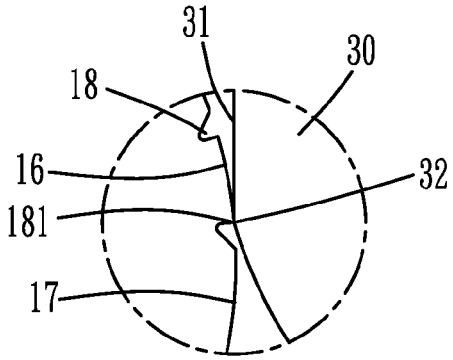
FIG. 5D is an enlarged view to show that the corner bites the rounded side of the fastener head.
Figure 5C:
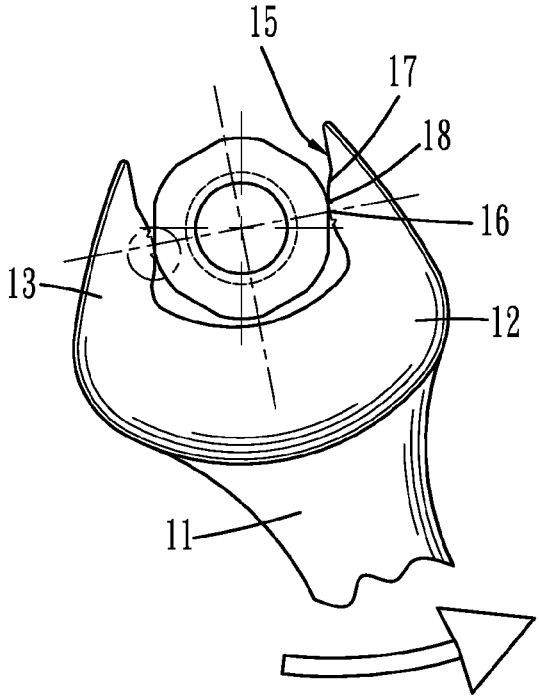
FIG. 5C shows that a rounded fastener head is clamped by the two jaws of the wrench of the present invention and the wrench is rotated counter clockwise.

Referring to FIGS. 5A to 5B, when a rounded fastener head 30 is clamped by the two jaws 13, and the wrench is rotated clockwise, the contact portions 16 are in contact with the rounded sides 31 of the rounded fastener head 30 and the corners 181 bite the rounded sides 31 so that the rounded fastener head 30 can be rotated. FIGS. 5C and 5D show that when the wrench is rotated counter clockwise, the corners 181 can bite the rounded fastener head 30 successfully.

Figure 3:
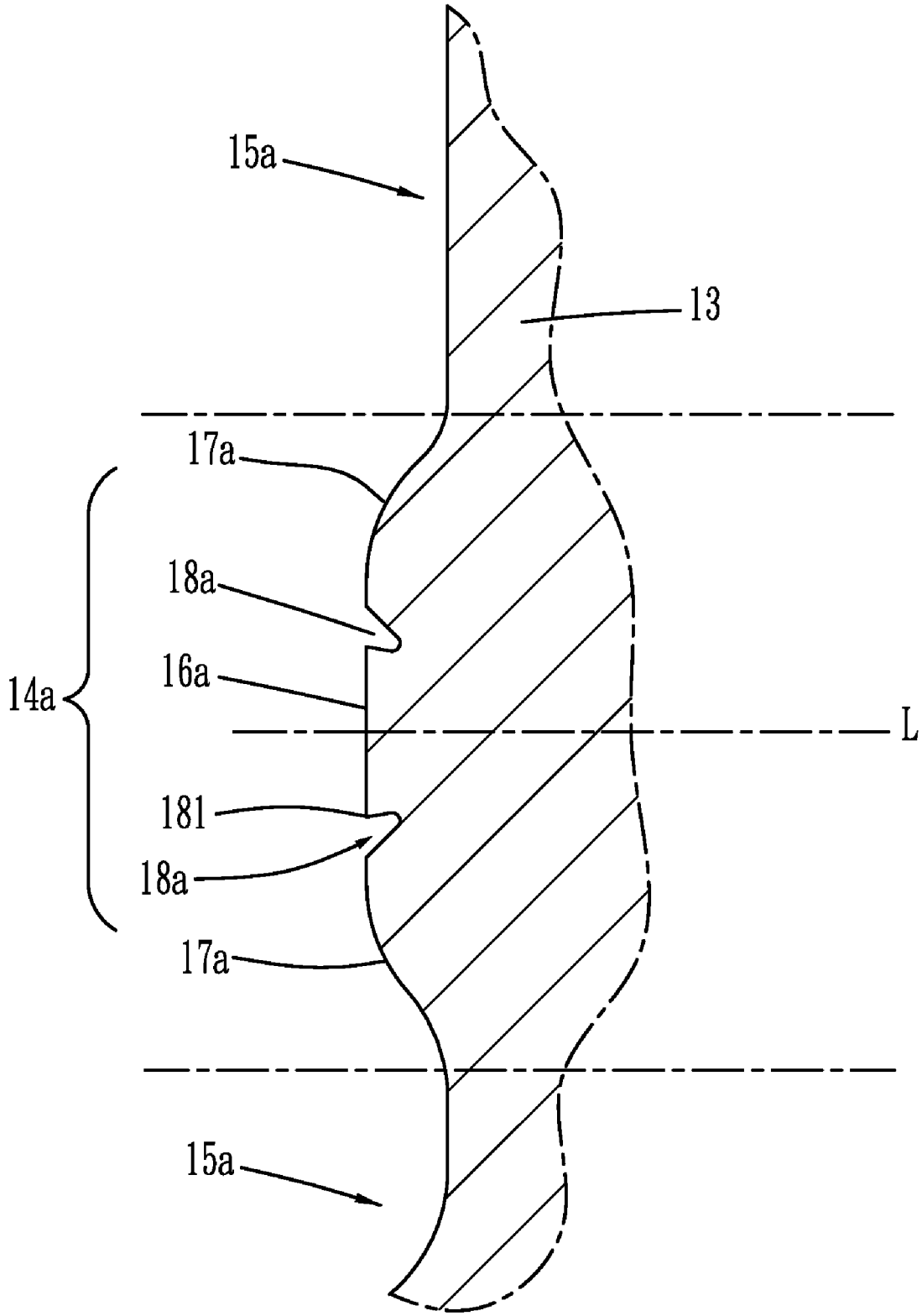
FIG. 3 is a cross sectional view to show another embodiment of jaws.

FIG. 3 shows another embodiment of the contact area 14*a* wherein the contact portion 16*a* has a straight outer surface and the contact area 14*a* is located between the two yielding areas 15*a* of each driving surface. The contact portion 16*a* is located between the two notches 18*a*. Two extension areas 17*a* each are connected between the yielding area 15*a* and the notch 18*a* corresponding thereto. A corner 181 is formed at a joint area of the contact portion 16*a* and an inside of the notch 18*a*. Each contact portion 16*a* includes a curved outer surface and a bisection line ${}_i{}^{\circ}L_i\pm$ of each jaw 13*i* perpendicular to a longitudinal axis of each jaw 13 and passes through a middle point of the contact portion 16*a*. The two yielding areas 15*a* are a straight area and a curved and recessed area respectively, wherein the straight area is located remote to a root portion of the open-end 12.

Figure 6A:
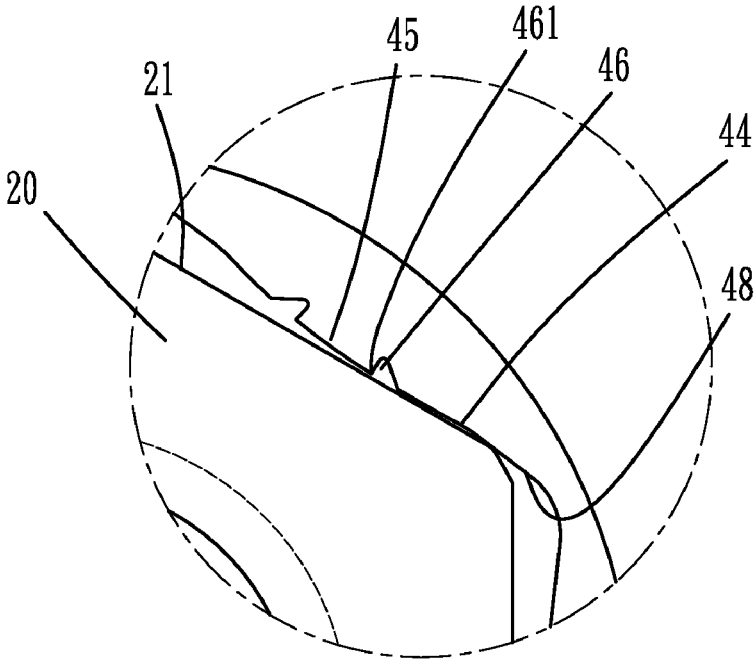
FIG. 6A shows the contact area is in contact with the side of the fastener.
Figure 6:
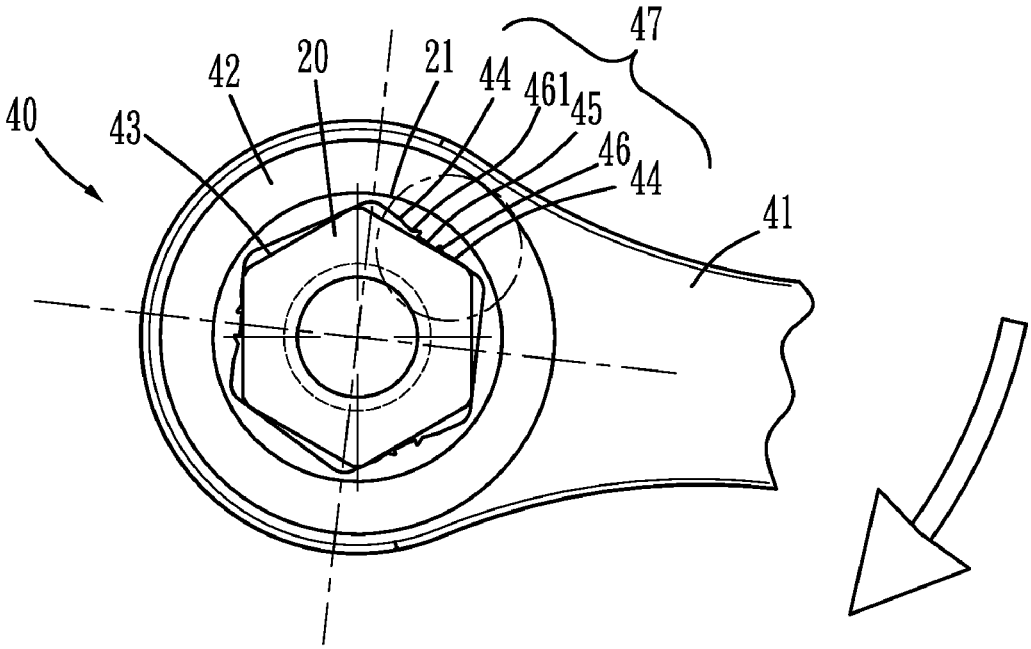
FIG. 6 shows a fastener head is clamped by a box-end of the wrench of the present invention.

FIGS. 6 and 6A show that the wrench 40 can be an box-end 42 connected to an end of a handle 41 and the box-end 42 has a passage 43 defined longitudinally therethrough and a plurality of driving surfaces are defined in an inner periphery of the passage 43. Three driving surfaces have a contacting area 47 and two yielding areas 48. The three driving surfaces having the contacting area 47 and the yielding areas 48 are arranged alternatively among all of the driving surfaces of the box-end 42. The contacting area 47 is located between the two yielding areas 48 and includes a contact portion 45 and two notches 46. The contact portion 45 is located between the two notches 46. Two extension areas 44 each are connected between the yielding area 48 and the notch 46 corresponding thereto. Each notch 46 has a plane surface and an inclined surface formed therein. A perpendicular corner 461 is formed at a joint area of the contact portion 45 and the plane surface of the notch 46, and an obtuse corner is formed at a joint area of the inclined surface and the extension area 44. Each contact portion 45 includes a curved outer surface. More specifically, the contact portion 45 and the two extension areas 44 as a whole define a protrusive arced surface, and the arced surface has discontinuous points at the two notches 46. The contact portion 45 is the most protrusive part of the arced surface. When rotating a normal fastener head 20 and the wrench 40 is rotated clockwise, the extension areas 44 are in contact with three sides 21 of the fastener head 20 which is then rotated with the wrench 40.

Figure 7A:
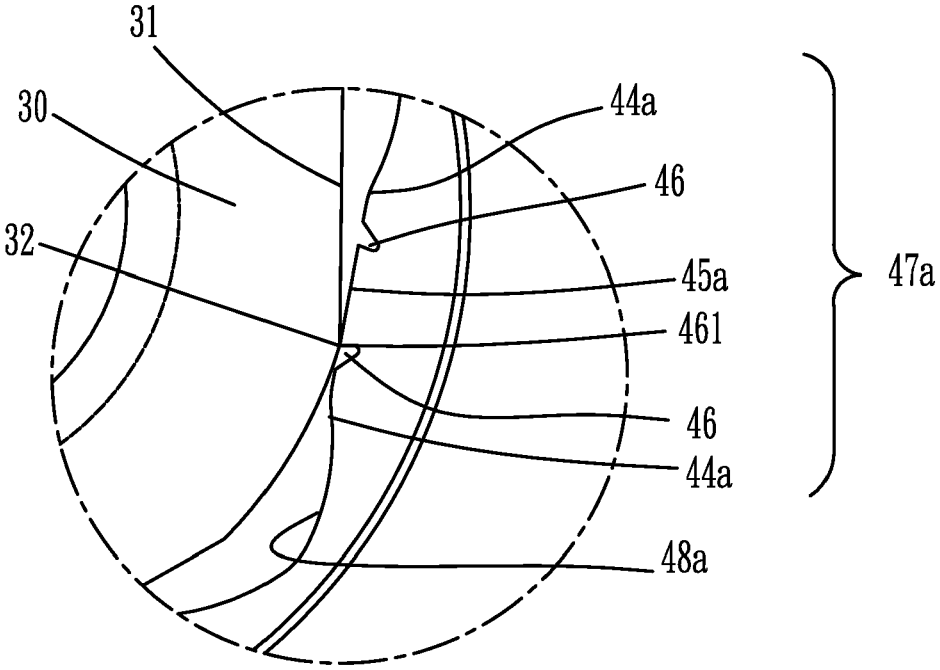
FIG. 7A shows that the corner bites the rounded side of the rounded fastener head.
Figure 7:
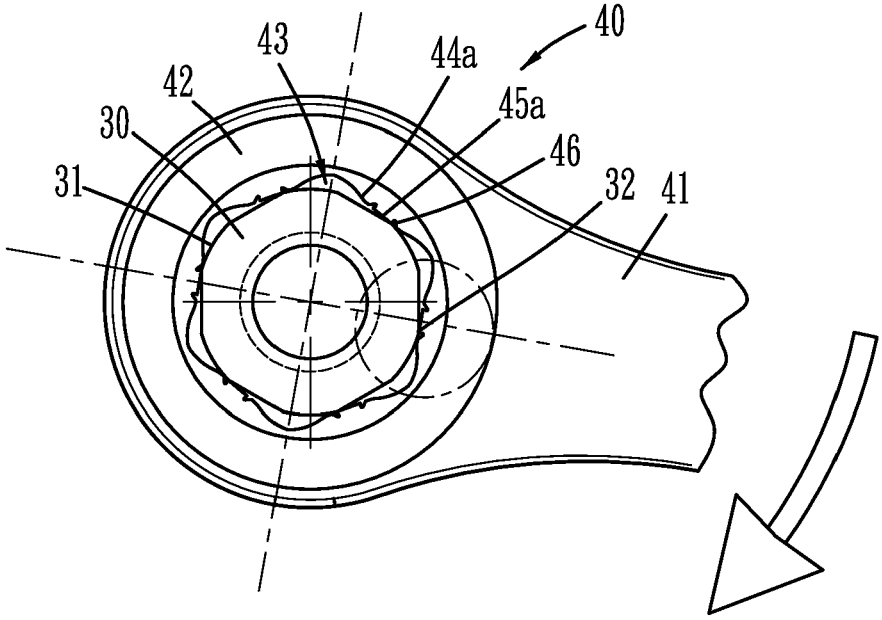
FIG. 7 shows a rounded fastener head is clamped by a box-end of the wrench of the present invention.

FIGS. 7 and 7A show another embodiment, wherein each of the driving surfaces of the box-end 42 includes the contacting area 47*a* and the yielding areas 48*a*. The contact portion 45*a* of the contacting area 47*a* has a straight outer surface and the two notches 46 are defined in each driving surfaces of the box-end 42. A corner 461 is formed at a joint area of the contact portion 45*a* and an inside of the notch 46. Two extension areas 44*a* each are connected between the yielding area 48*a* and the notch 46 corresponding thereto. When a rounded fastener head 30 is engaged with the box-end 42, and the wrench 40 is rotated clockwise, the corners 461 bite the rounded sides 31 of the fastener head 30 and the corners 32 of the rounded fastener head 30 is located at the notches 46 so that the corners 32 will not be further marred.

Figure 8B:
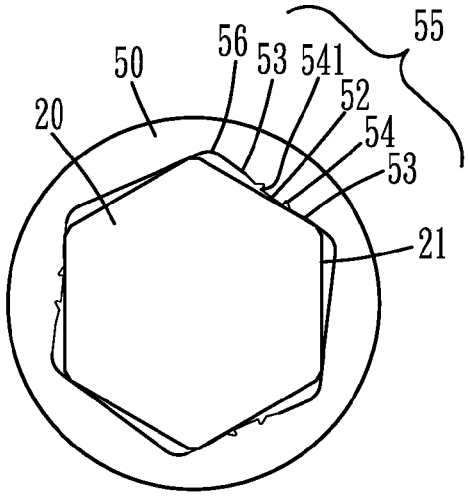
FIG. 8B shows that a normal fastener head is engaged with the socket in FIG. 8A.
Figure 8A:
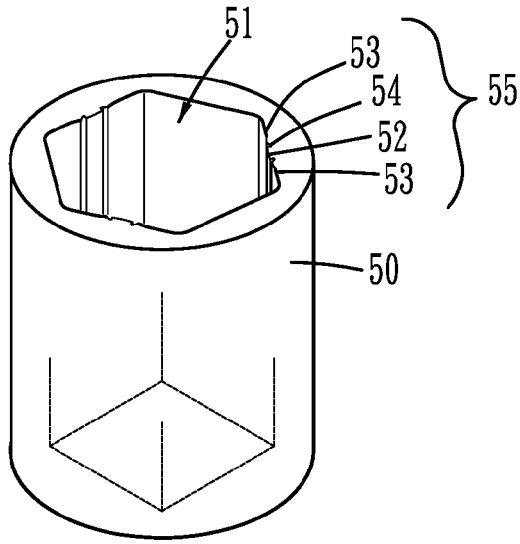
FIG. 8A shows a socket having the contact area and the yielding areas.

FIGS. 8A and 8B show that the contacting area 55 and the yielding areas 56 can be used to the driving surfaces 51 of a socket 50. The contact portion 52 has a curved outer surface and the two notches 54 are defined so that the contact portion 52 is located between the notches 54. The extension areas 53 each are connected between the yielding area 56 and the notch 54 corresponding thereto. A corner 541 is formed at a joint area of the contact portion 52 and an inside of the notch 54.

Figure 8D:
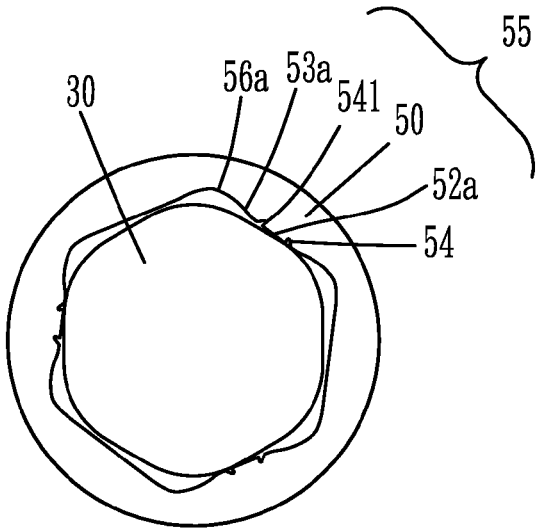
FIG. 8D shows that a rounded fastener head is engaged with the socket in FIG. 8C.
Figure 8C:
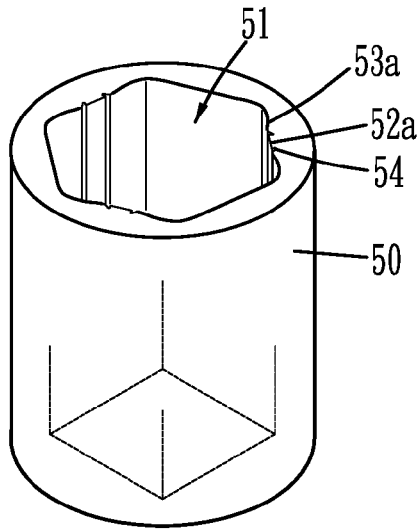
FIG. 8C shows another embodiment of the contact area used in the socket.

FIGS. 8C and 8D show another embodiment wherein that the contacting area 55 and the yielding areas 56*a* can be used to the driving surfaces 51 of a socket 50. The contact portion 52*a* has a straight surface and the two notches 54 are defined so that the contact portion 52*a* is located between the notches 54. The extension areas 53*a* each are connected between the yielding area 56*a* and the notch 54 corresponding thereto. A corner 541 is formed at a joint area of the contact portion 52*a* and an inside of the notch 54.

While we have shown and described the embodiment in accordance with the present invention, it should be clear to those skilled in the art that further embodiments may be made without departing from the scope of the present invention.

What is claimed is:

1. A wrench comprising: a handle and an open-end connected to the handle and the open-end having two jaws, each jaw having a driving surface and the two driving surfaces of the two jaws facing each other, each driving surface having a contacting area and two yielding areas, the contacting area located between the two yielding areas of each driving surface and the contacting area including a contact portion and two notches, each of the notches having a plane surface and an inclined surface formed therein, the contact portion including a curved outer surface and being located between the two notches, two extension areas each connected between the yielding area and the notch corresponding thereto, a perpendicular corner formed at a joint area of the contact portion and the plane surface of the notch, and an obtuse corner formed at a joint area of the inclined surface and the extension area;

wherein the contact portion and the two extension areas as a whole define a protrusive arced surface which has discontinuous points at the two notches, the contact portion is the most protrusive part of the arced surface.

2. The wrench as claimed in claim 1, wherein a bisection line is perpendicular to a longitudinal axis of each jaw and passes through a middle point of the contact portion.

3. The wrench as claimed in claim 1, wherein the two yielding areas are a straight area and a curved and recessed area respectively.

4. The wrench as claimed in claim 3, wherein the straight area is located remote to a root of the open-end.

5. The wrench comprising: a handle and a box-end connected to the handle and the box-end having a passage defined longitudinally therethrough and a plurality of driving surfaces being defined in an inner periphery of the passage, at least one of the driving surfaces having a contacting area and two yielding areas, the contacting area located between the two yielding areas of each driving surface and the contacting area including a contact portion and two notches, each of the notches having a plane surface and an inclined surface formed therein, the contact portion including a curved outer surface and being located between the two notches, two extension areas each connected between the yielding area and the notch corresponding thereto, a perpendicular corner formed at a joint area of the contact portion and the plane surface of the notch, and an obtuse corner formed at a joint area of the inclined surface and the extension area;

wherein the contact portion and the two extension areas as a whole defines a protrusive arced surface which has discontinuous points at the two notches, the contact portion is the most protrusive part of the arced surface.

6. The wrench as claimed in claim 5, wherein each of the driving surfaces has the contacting area and the yielding areas.

7. The wrench as claimed in claim 5, wherein the driving surfaces having the contacting area and the yielding areas are arranged alternatively among all of the driving surfaces of the box-end.

* * * * *